United States Patent [19]

Briner et al.

[11] 4,185,612

[45] Jan. 29, 1980

[54] HEAT CIRCULATING FIREPLACE

[75] Inventors: Clifton F. Briner, Huntington; Rodney A. Hempel, Fort Wayne, both of Ind.

[73] Assignee: American Standard Inc., New York, N.Y.

[21] Appl. No.: 856,713

[22] Filed: Dec. 2, 1977

[51] Int. Cl.[2] ..... F24B 7/00

[52] U.S. Cl. ..... 126/122; 237/51; 126/121

[58] Field of Search ..... 126/120, 121, 122, 129, 126/130, 131, 61, 66, 80, 89, 285 R, 293; 237/51

[56] References Cited

U.S. PATENT DOCUMENTS

| | | | |
|---|---|---|---|
| 266,613 | 10/1882 | Deardorff | 126/122 |
| 1,514,360 | 11/1924 | York | 126/122 |
| 2,362,526 | 11/1944 | Austin | 126/121 |
| 2,471,351 | 5/1949 | Russell | 237/51 |
| 3,762,391 | 10/1973 | Andrews | 126/121 |
| 3,866,595 | 2/1975 | Jones | 126/121 |
| 4,008,707 | 2/1977 | Bartlett | 126/121 |

FOREIGN PATENT DOCUMENTS

| | | | |
|---|---|---|---|
| 211350 | 9/1954 | Austria | 126/121 |

*Primary Examiner*—Samuel Scott
*Assistant Examiner*—G. A. Anderson
*Attorney, Agent, or Firm*—James J. Salerno, Jr.; Robert G. Crooks

[57] ABSTRACT

This invention is directed to a fireplace heat exchanger and air conducting means arranged and constructed to recover and utilize substantial quantities of heat energy which normally would be expelled to the outside atmosphere via the flue. This assemblage includes a heat exchanger surface which increases the quantity of heat being transferred from the combustion gases of the fuel being burned in the combustion chamber of a fireplace to the air passing through the heat exchanger. The assemblage is capable of being constructed as an insert module assembly for use with an existing fireplace or may be constructed as original equipment in prefabricated and ceramic fireplaces. The heat exchanger surface is formed having an increased surface area greater than the surface area of the rear wall of the combustion chamber and is provided with vertically oriented gas pathways so that a greater quantity of heat energy stored in the flue gases can be transferred from the combustion gases on the one side of the heat exchanger surface to the air to be heated on the other side thereof. The heat exchanger surface is made of a relatively lightweight metallic material in order to offer minimum thermal resistance to the heat flow. An air conducting means having inlet air and outlet air ducts coupled to each side of the heat exchanger module is provided to conduct air to be heated into and away from the heat exchanger. Air control means including a fan mounted in fluid communication with the heat exchanger and air conducting means is provided to regulate and proportion outside and/or room air entering the heat exchanger.

34 Claims, 17 Drawing Figures

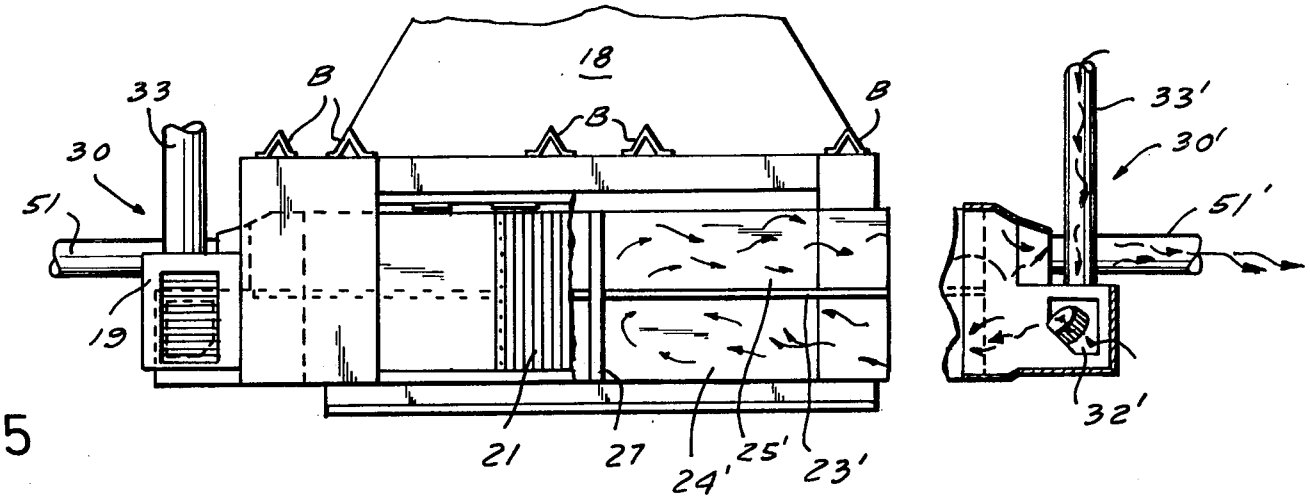
FIG. 5
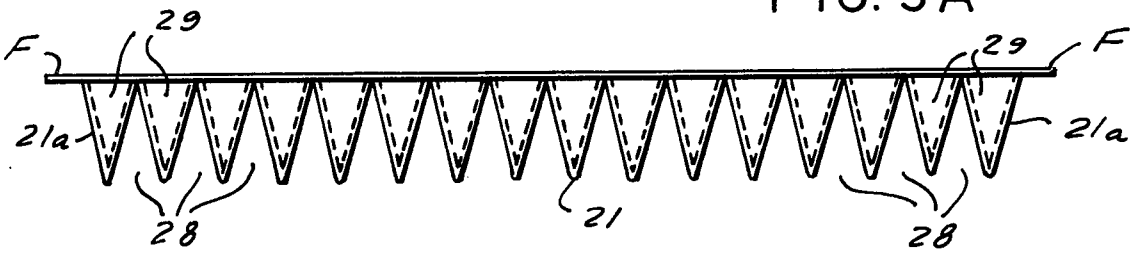
FIG. 5A
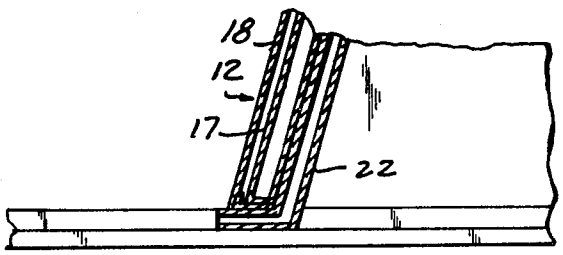
FIG. 8A
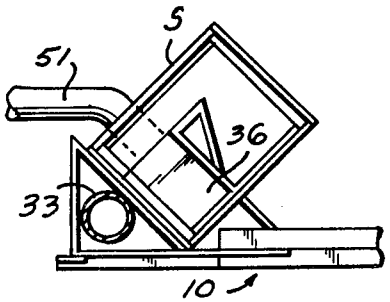

HEAT CIRCULATING FIREPLACE

RELATED APPLICATION

Co-pending application of Kenneth Mahoney and David Johnson for "Air Control Assembly for Heat Circulating Fireplace" is concurrently filed herewith.

BACKGROUND OF THE INVENTION

1. Field of the Invention

This invention relates to a fireplace duct insert and air conducting means, more particularly, a heat exchanger and conduit system which is capable of discharging heated air to a room or rooms thereby making a fireplace more useful as a supplemental source of heat.

2. DESCRIPTION OF THE PRIOR ART

Fireplace designs which utilize the available heat from the burning fuel are known. Heat ducts surrounding the combustion chamber provide air passages which warms the air as it passes therethrough. Others employ fan means in order to increase the circulation of air through the heat duct such as is described in U.S. Pat. No. 3,762,391. Also various designs of heat duct assemblies can be made to fit in an existing combustion chamber of a fireplace, as shown in U.S. Pat. Nos. 3,880,141, 3,896,785, 3,995,611, 3,965,886, and 4,008,707.

SUMMARY OF THE INVENTION

It is an object of the invention to provide a heat exchanger having an improved heat exchanger surface with a high energy transfer efficiency.

Another object of the invention is to provide an increased quantity of heat transfer by utilizing a heat exchanger surface which is of relatively lightweight construction and which is positioned between the hot combustion gases of the fire in the combustion chamber and the air to be heated with means for conducting the heated air to the fireplace room and/or to the adjacent rooms.

It is an object of the invention to provide auxiliary convection heating to the room in which the fireplace is located and/or additional rooms by means of heat circulating ducts coupled to an insert module.

It is another object of the invention to provide an insert module including a heat exchanger which is insertable into an existing fireplace or may be included as original equipment in prefabricated or ceramic fireplaces.

In one embodiment of the invention it is an object to provide means for supplying outside air to the fireplace room to improve draft from the room to the firebox thus promoting a more uniform and complete combustion of fuel.

Still another object of the invention is to provide a heat exchanger surface which is capable of resisting high temperatures experienced during the combustion of fuel in a fireplace and which will not deform or deteriorate during the fuel burning cycle.

Another object of the invention is to provide a prefabricated fireplace assembly having an insert module which has air conduit means which is in fluid communication with an included heat exchanger surface for the purpose of increasing the quantity of heated air discharged from the fireplace.

Another object of the invention is to provide a prefabricated fireplace assembly having an insert module which has increased mass rate of air flow through the heat exchanger and conduit system, and which provides improved cooling of the fireplace assembly.

Another object of the invention is to provide an air control system which can be varied to discharge heated air within the room housing the fireplace and/or into adjacent rooms.

Another object of the invention is to provide baffle means for dividing the heated air being discharged on each side of the fireplace.

Another object of the invention is to provide a heat insert module which is made of nonmasonry materials, is prefabricated utilizing lightweight metal materials and can be constructed in modular units.

A further object of the invention is to provide an insert module and heat exchanger assembly which is inexpensive and made of lightweight component parts and is relatively easy to manufacture and assemble.

The invention generally contemplates providing a heat exchanger and air circulating means for a fireplace which is arranged and constructed to recover and utilize substantial quantities of heat energy from the flue gases which normally would be expelled to the outside atmosphere. The fireplace includes an insert module having a heat exchanger surface which is coupled to an air conduit system and is adapted to be mounted in an existing fireplace or may be part of the original fireplace assembly. The heat exchanger surface is mounted in fluid communication with the inlet air and outlet air ducts and is capable of increasing the quantity of heat transferred from the combustion gases to the air to be heated.

It is also contemplated that the basic element of the present invention is in the form of an insert module assembly in which a large variety of integral assemblies in the form of kits can be incorporated with the insert module assembly either as factory additions and/or consumer added kits. Such kits may include fan assemblies, air temperature control assemblies, remote duct assemblies, damper mechanisms or the like.

The air conduit system includes inlet air ducts and heated outlet air ducts which are mounted to each side of the heat exchanger. Fan means are adapted to be mounted in fluid communication with the air inlet ducts for conducting air to be heated through the insert module. The heat exchanger surface is provided with vertically oriented gas conducting paths which are in heat transfer contact with the air to be heated on one side and the combustion gases on the other side thereof. The heated air is conducted through the outlet ducts to be discharged into the area adjacent to or remote from the fireplace. Air control means is associated with the fan means and is capable of introducing outside air and/or room air through the insert module to maintain a predetermined temperature of heated air to be discharged. In a preferred form of the invention, the heat exchanger surface is formed of stainless steel of relatively thin gauge and is convoluted in a vertical direction so that in cross section it appears to be a ribbon folded upon itself. The heat exchanger surface is constructed having vertically oriented air passageways or channels for conducting combustion gases vertically upwards on the one side and air to be heated on the other side; the surfaces defining the passageways having an area greater than the surface area of the rear wall of the combustion chamber.

BRIEF DESCRIPTION OF THE DRAWINGS

FIG. 5 is a front elevational view, partially broken away, of the preferred air flow path typical of the invention herein;

FIG. 5A is a top plan view of one form of the heat exchanger taken along lines 5A—5A of FIG. 2;

FIG. 8A is a view similar to FIG. 8 but illustrates the air conducting means positioned at a remote location from the fireplace proper.

DESCRIPTION OF THE PREFERRED EMBODIMENT

Figure 1:
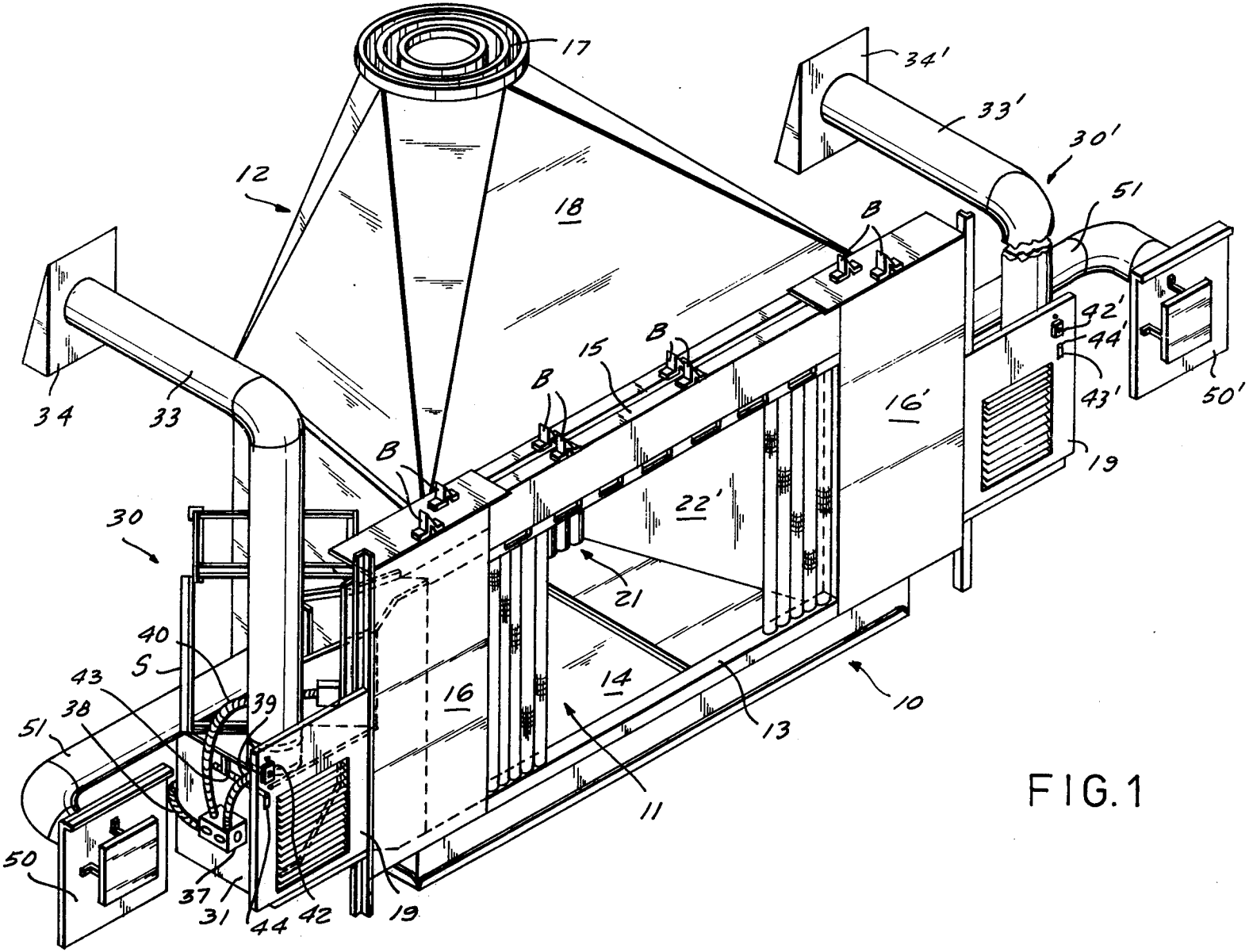
FIG. 1 is an isometric view of the assembly of a heat circulating fireplace of one form of the invention.

The present invention is illustrated in the accompanying Figures wherein similar components are indicated by the same reference numerals throughout the several views and where pairs of components are used, the component is referenced by prime of the reference numeral.

Referring to FIG. 1 which illustrates a prefabricated fireplace assembly 10 in isometric view of the invention herein, the fireplace assembly 10 comprises a prefabricated fireplace 12 substantially as described in U.S. Pat. No. 2,821,975. The fireplace includes combustion chamber 14 having an intermediate fireplace casing 17 surrounding combustion chamber 14 and spaced therefrom and the outer fireplace casing 18 which in turn surrounds the intermediate fireplace casing 17 and is spaced therefrom so as to leave an air space between them. Fireplace assembly 10 is coupled to a thermosiphonic chimney, not shown, having certain features in common with the chimney of U.S. Pat. No. 2,634,270. The thermosiphonic chimney carries combustion products away from the fireplace and also provides an air stream which cools the fire box of the fireplace as well as the flue and other members of the thermosiphonic chimney.

Mounted in the front of fireplace 10 is a closure assembly 11 which includes a hearth extension 13, a top panel 15, and a pair of side panels 16, 16'. A sliding metal mesh screen which opens and closes the opening of combustion chamber 14 is mounted between side panels 16, 16'.

Figure 2:
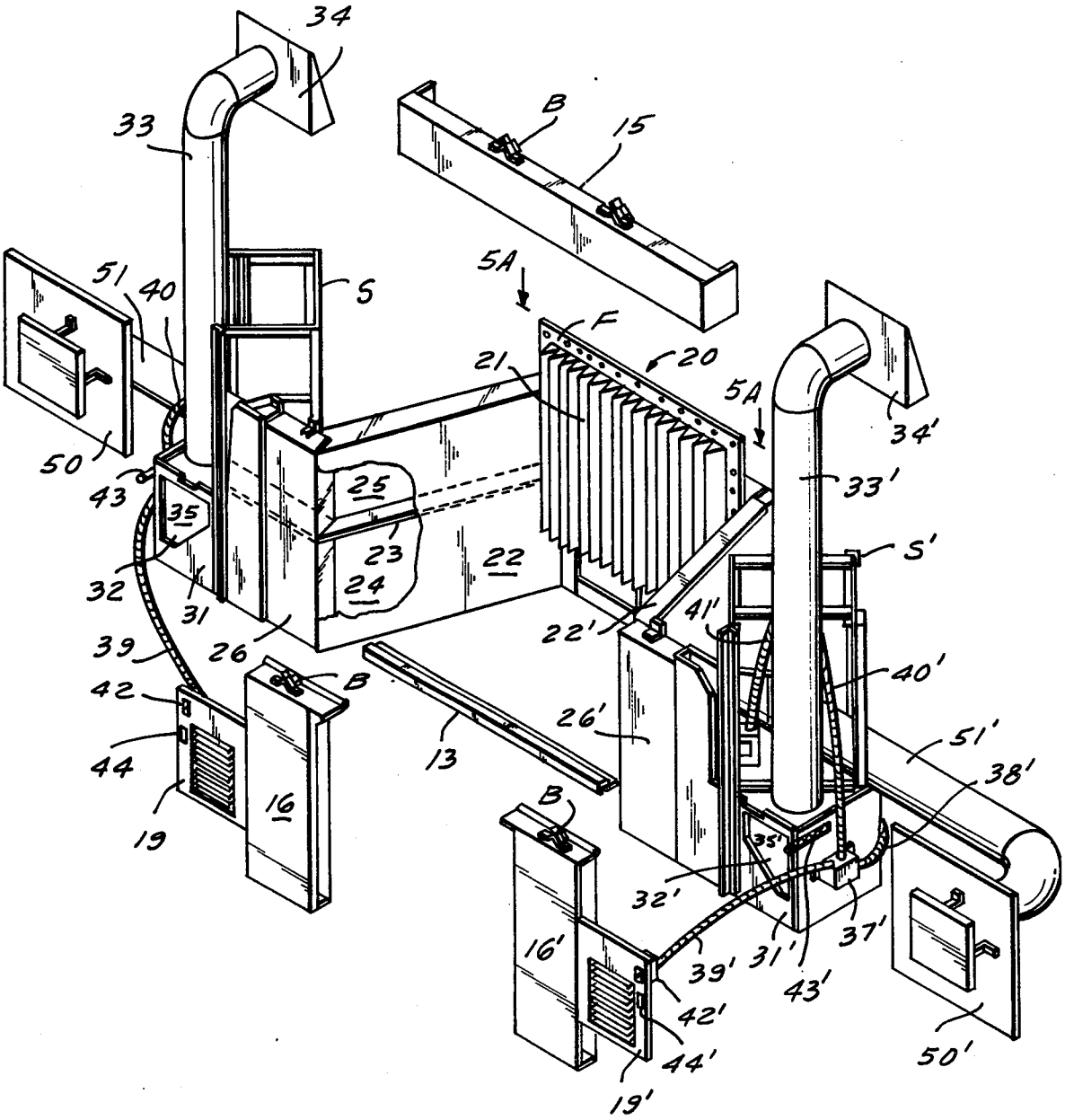
FIG. 2 is a partially exploded isometric view of the form of FIG. 1.

FIG. 2 is a partially exploded isometric view of the form of FIG. 1 with the fireplace 10 removed. More particularly, FIG. 2 illustrates the assembly of insert module 20 and air conducting means 30, 30'. In this connection, the assembly of FIG. 2 can be constructed as original equipment to be mounted in fireplace 10 or can be made separately for installing into an existing fireplace. Where an existing fireplace is to be utilized such as is disclosed in U.S. Pat. No. 2,821,975, the rear firebrick wall is removed along with the sideliner panels. It has been found that these components of the fireplace are not required when utilizing the present form of the invention because the heat extracted for room heating by the heat exchanger and conduit does not penetrate through the fire casing. Insert module 20 includes a heat exchanger surface 21 which is coupled in fluid communication to left and right heat exchanger ducts 22, 22'. An air flow divider 23, 23' is positioned between the top and bottom of heat exchanger ducts 22, 22' to provide inlet air ducts or plenums 24, 24' and outlet air ducts or plenums 25, 25'. A vertical baffle 27 is mounted within heat exchanger duct 22, 22' to separate left and right inlet air and outlet air ducts 24, 24', 25, 25'. Heat exchanger ducts 22, 22' extend along the left and right side walls respectively of the fireplace combustion chamber 14 and the rear wall thereof. Extending along the left and right front walls of the fireplace are heat exchanger duct extensions 26, 26' which also include the extension of air flow divider 23, 23' to form extension of inlet air ducts 24, 24' and outlet air ducts 25, 25'.

Mounted to the inlet air opening of ducts 24, 24' are air conducting means 30, 30'. Air conducting means 30, 30' includes a blower box or housing 31, 31' having a front opening 32, in which room air may be introduced into inlet air ducts 24, 24'. An opening, not shown, in the top of blower box 31, 31' includes a mounting collar for coupling fresh inlet air ducts 33, 33'. Coupled to the blower box 31, 31' is fan means, not shown, for example, squirrel-cage type fan and motor assembly in which the outlet thereof is coupled coupled to inlet air ducts 24, 24'. The electrical utility box 37, 37', and flexible conduits 38, 38', 39, 39', 40, 40', 41, 41' carry the electrical wiring for controlling the fan and/or air conducting means 30, 30'. The fan switch 42, 42' is mounted on the face of room inlet air grille 19, 19' which covers opening 32, 32' of blower box 31, 31'. Also, damper control lever 43, 43' of air control means 30, 30' is mounted on blower box 31, 31' and is operatively coupled to the damper mechanism mounted therein. The damper mechanism may be manually controlled to proportion the amount of outside air and room air entering inlet air ducts 24, 24'. Damper control lever 43, 43' extends through an opening 44, 44' of room inlet air grille 19, 19'.

Figure 8:
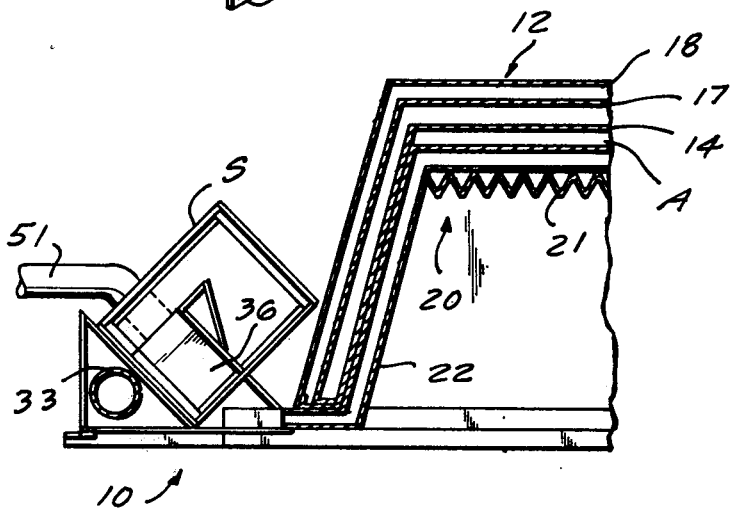
FIG. 8 is a fragmentary horizontal sectional view of the fireplace assembly of FIG. 1 with the dome section removed.

Air conducting means 30, 30', shown in FIGS. 5 and 8, includes inlet air chamber 35, 35' and outlet air chamber 36, 36' which are separated by an extension of baffle 23 to prevent mixing of the inlet air supply with the outlet air supply. Attached to outlet air chamber 36, 36' is a collar to receive warm outlet air duct 51; a like assembly is mounted to heat exchanger duct 25'. Shroud or frame "S" extends vertically from inlet air chamber 35, 35' to maintain a space between air conducting means 30, 30' and the wood frame structure. The air space acts as an insulating barrier between the wood structure and the outlet air chamber 36, 36'. Outlet air grille 50, 50' is mounted on the end of warm outlet air duct 51, 51'. Outlet air grille 50, 50' may be mounted in the fireplace room or in adjacent rooms. By locating the inlet air opening 32, 32' of duct 24, 24' below outlet air opening of duct 25, 25' a further advantage of maintaining a natural convection of heated air through the insert module is provided when the fan means are not operating, for example, during power outages. Also air conducting means 30, 30' may be positioned at a remote location from the fireplace proper. All that is required is to provide extension ducts between inlet air and outlet air chambers 35, 35', 36, 36' and panel extensions 26, 26'.

Figure 3:
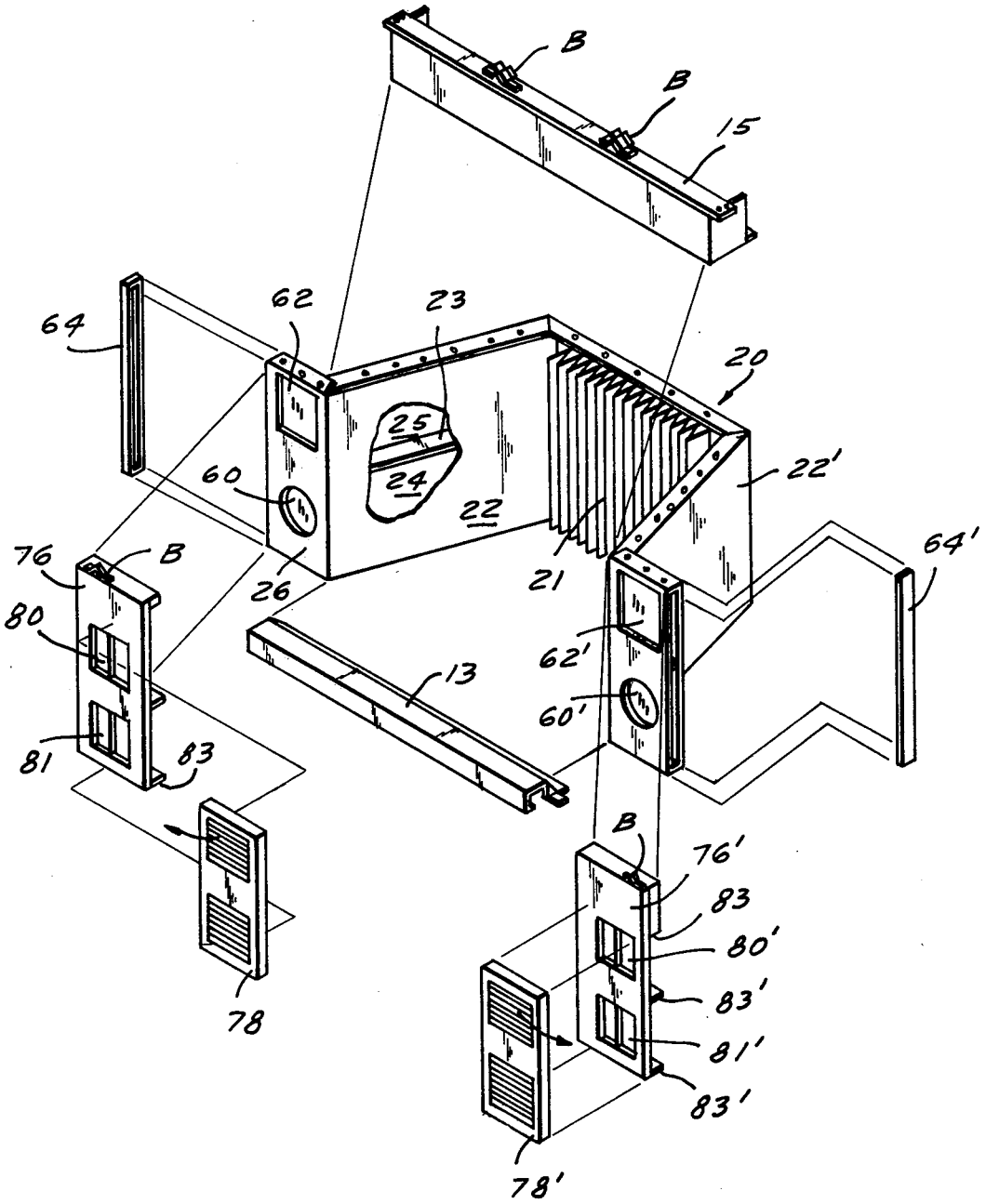
FIG. 3 is an exploded isometric view of a second form of the invention without the outside air conducting and control assembly shown in FIG. 1.

FIG. 3 is similar to FIG. 2 except that the air conducting means 30, 30' is modified. Insert module 20 includes a heat exchanger surface 21 and is mounted in heat transfer contact with left and right heat exchanger duct 22, 22'. An air flow divider 23, 23' is positioned between the top and bottom of heat exchanger duct 22, 22' and vertical baffle 27 as discussed in FIG. 2, to form left and right inlet and outlet air ducts or plenums 24, 24' and 25, 25'. THe heat exchanger duct extension 26, 26' illustrated in FIG. 2 has been modified to provide room inlet air opening 60, 60' and outlet air opening 62, 62'. Room inlet air opening 60, 60' is formed in the front face of heat exchanger duct 26, 26' and is positioned between air flow divider 23, 23' and the bottom of heat exchanger duct extension 26, 26'. Outlet air opening 62, 62' is similarly formed on the front face of heat exchanger extension duct 26, 26' and is positioned between the top thereof and air flow divider 23, 23'. End cap plates 64, 64' are mounted in sealed position over the ends of heat exchanger duct extension 26, 26' so that all air entering opening 60, 60' passes through inlet air duct 24, 24', passes vertically upwardly in heat transfer contact with the primary heat exchanger surface 21, through outlet air duct 25, 25' and then through outlet air opening 62, 62'. Side panel 76, 76' is mounted on heat exchanger extension duct 26, 26' and has corresponding top and bottom openings 80, 80' and 81, 81' respectively and are aligned with inlet air opening 60, 60' and outlet air opening 62, 62' respectively. Horizontal spaced baffles 83, 83' contact the front face of extension panel 26, 26' to provide an air barrier between the inlet and outlet air openings on duct extensions 26, 26'. Louvered grille 78, 78' is removably mounted on side panel 76, 76' in which top and bottom louver sections are aligned with openings 80, 80' and 81, 81' respectively.

FIG. 5 illustrates a front elevational view partially broken away of the preferred air flow path typical of the invention herein. Air flow divider 23' is shown as a horizontal member mounted in heat exchanger duct 22'. A vertical baffle or air flow divider 27 separates heat exchanger surface 21 and heat exchanger ducts 22, 22' into left and right sections so that air entering the right side will flow through inlet air duct 24', be diverted upwardly in the direction of the arrows along the right side of heat exchanger surface 21 by the vertical baffle 27 and then turned 90° to be conducted through outlet air grille 30', not shown, to be expelled into the room of the fireplace or into an adjacent room or rooms. The room air entering the left side of the insert module flows in a symmetrical path so that uniform heating of air is obtained and is discharged through outlet air grille 50, not shown. Room air and outside air are introduced in controlled amounts through room air inlet opening 32, 32' and through outside inlet air duct 33, 33' either by use of a manually or automatically operated damper mechanism. The combined air is then conducted under positive pressure through heat exchanger duct 24, 24' as indicated above. It should be noted that locating the forced air means at the inlet opening 32' of duct 24' provides two advantages: first, the fan assembly is surrounded by cool inlet air rather than hot discharged air; and second, the internal portions of the insert module are under positive pressure which prevents possible infiltration of combustion gases from fuel into the heated room air. By locating the inlet opening 32, 32' of duct 24, 24' below the outlet opening of duct 25, 25' the capability of providing natural convection heating during power outages without thermal damage to the fan can also be realized.

FIG. 5A illustrates the plan view of heat exchanger surface 21. Heat exchanger surface 21 is formed having alternating air passageways which are separated by a relative thin metal barrier. Thus on one side of heat exchanger surface 21, that is, the side facing the combustion chamber of fireplace 10, combustion gases pass through combustion gas passageways 28 and air to be heated passes through air passageways 29. Heat exchanger surface 21 is formed of stainless steel with serially joined triangular members **21*a* which extend vertically across the rear wall of the combustion chamber. The serially joined triangular members 21*a* are mounted on a frame "F" which extends laterally to mate with the opening in duct 22 shown most clearly in FIG. 2. When heat exchanger surface 21 is mounted to heat exchanger duct 22 horizontal air divider 23, 23' and vertical air barrier 27 provide means by which air entering the right and left sides of fireplace 10 will cause the air to be moved in the direction of the arrows shown in FIG. 5. Thus air to be heated will pass upwardly through air passageways 29 while the combustion gases will pass upwardly through combustion gas passageways 28**.

Figure 4:
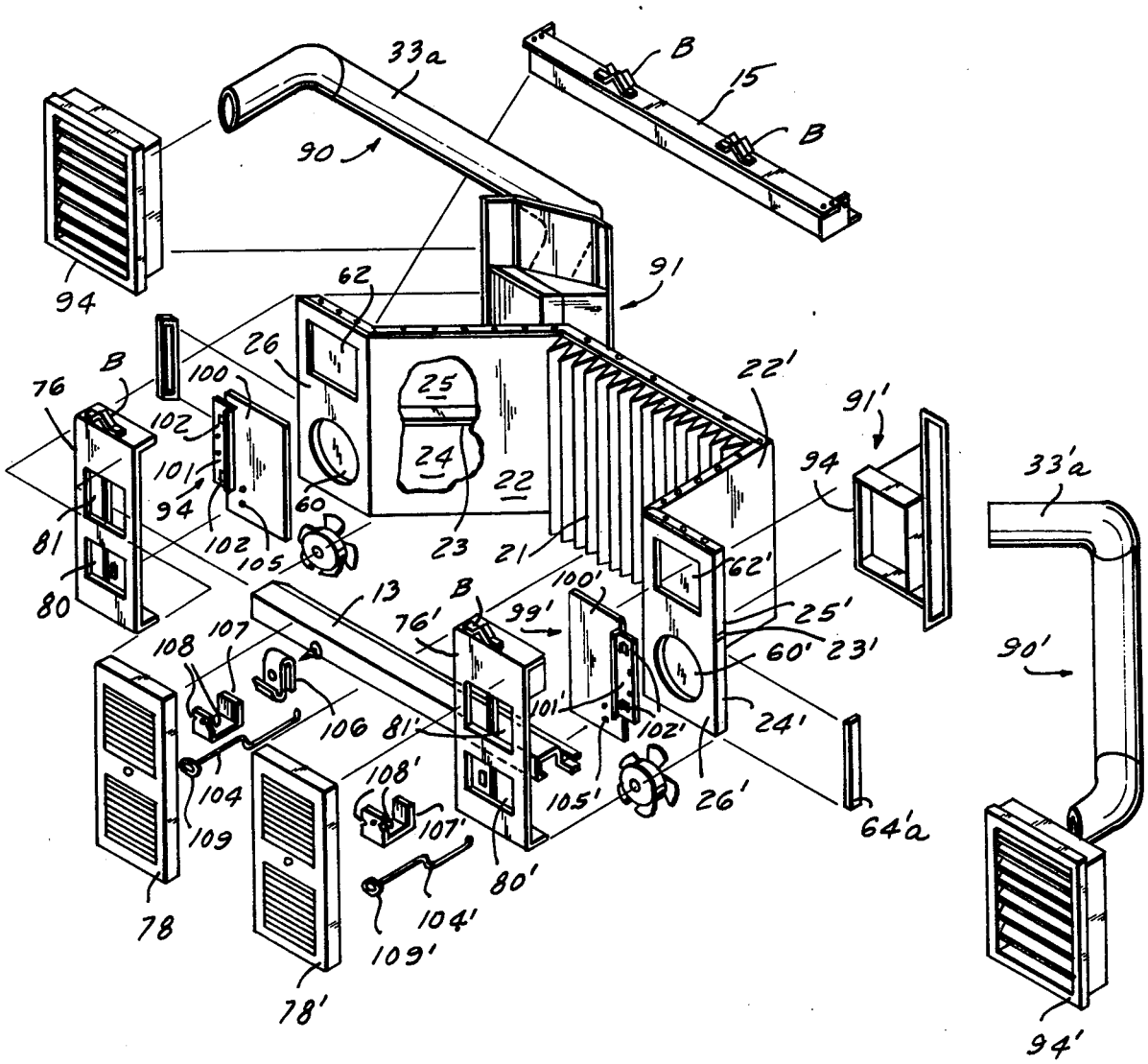
FIG. 4 is an exploded isometric view of a third form of the invention which illustrates the modular additions to the form of FIG. 3 of the invention.

FIGS. 4, 11, 12, 13, 14 and 15 illustrate another form of the invention of FIG. 3 in which a fan means, a modified air control assembly and remote duct assembly are provided. Insert module 20 as illustrated in FIG. 3 is designed to be the basic element of a large variety of primary factory additions or may be in the forms of kits, for example, the air control assembly 30, 30' of FIG. 2 or the fan assembly 70, 70', damper means 99, 99', transition duct 91, 91' and remote duct assembly **33*a*, 33'*a* of FIG. 4. Heat exchange module 20 of FIG. 4 is identical in construction as shown and discussed for FIG. 3 with the exception relating to the addition of fan means, air control means and remote duct assembly. End cap 64, 64' shown in FIG. 3 is removed and is replaced by inlet end cap 64*a*, 64'*a* and remote duct assembly 90, 90'. Remote duct assembly 90, 90' includes outlet air transition duct 91, 91' shown in FIGS. 12, 13, and 15, and is mounted on the open end 62*a* of heat exchanger duct extension 26, 26'. FIG. 4** illustrates one configuration of a fireplace which permits simple placement of the framing members such that the firebox, inlet and outlet air grilles are in a smooth unitary arrangement requiring no additional air inlet or outlet wall openings. When a remote duct system is employed, then only a remote air outlet opening is required, however, it does not detract from the basic modular appearance of the fireplace.

Figure 12:
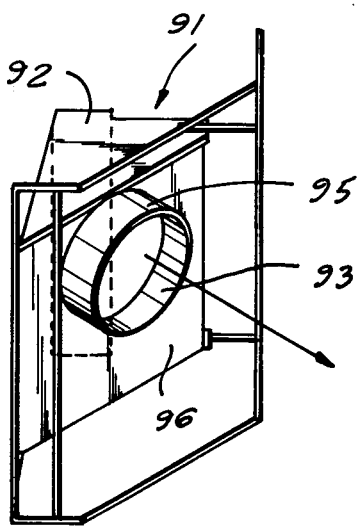
FIGS. 12 and 13 are isometric views of the transition duct assembly of the third form shown in FIG. 4.
Figure 13:
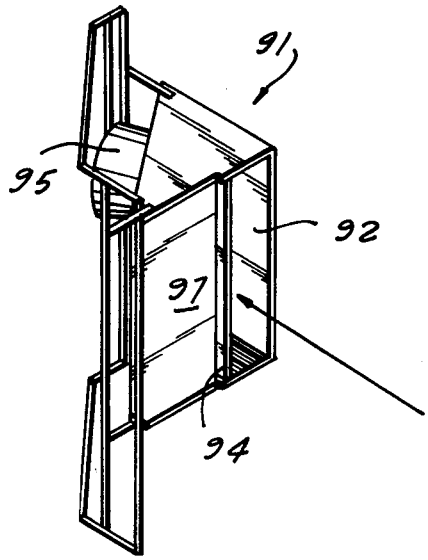
Figure 15:
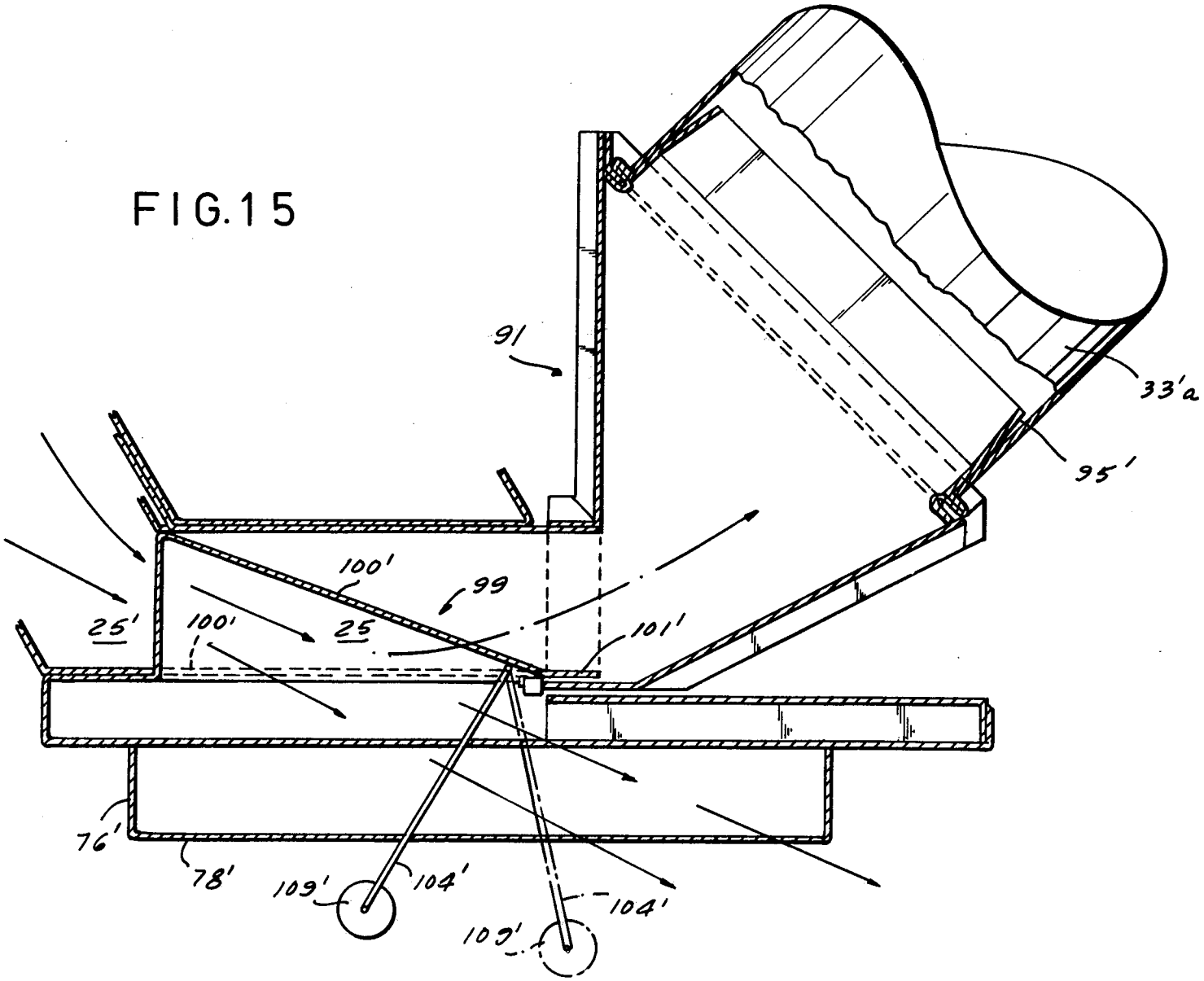
FIG. 15 is a horizontal sectional view of the transition duct assembly mounted to the outlet air duct of the insert module assembly as shown in FIG. 4 and illustrates the discharge air flow path therethrough.

FIGS. 12, 13 and 15 illustrate the transition duct 91, 91' utilized for the air control system which converts the rectangular outlet opening of outlet air duct 25, 25' to a circular opening 93 for outlet air duct 51, 51'. Transition duct 91, 91' is generally triangular in shape having a circular collar 95 extending outwardly from the vertical face 96 to form outlet air opening 93. A rectangular opening 92 having a flange 94 is formed on vertical side 97. Flange 94 telescopically connects with the rectangular opening of outlet air duct 25. Remote duct 33*a* is coupled to circular outlet air collar 95.

Figure 14:
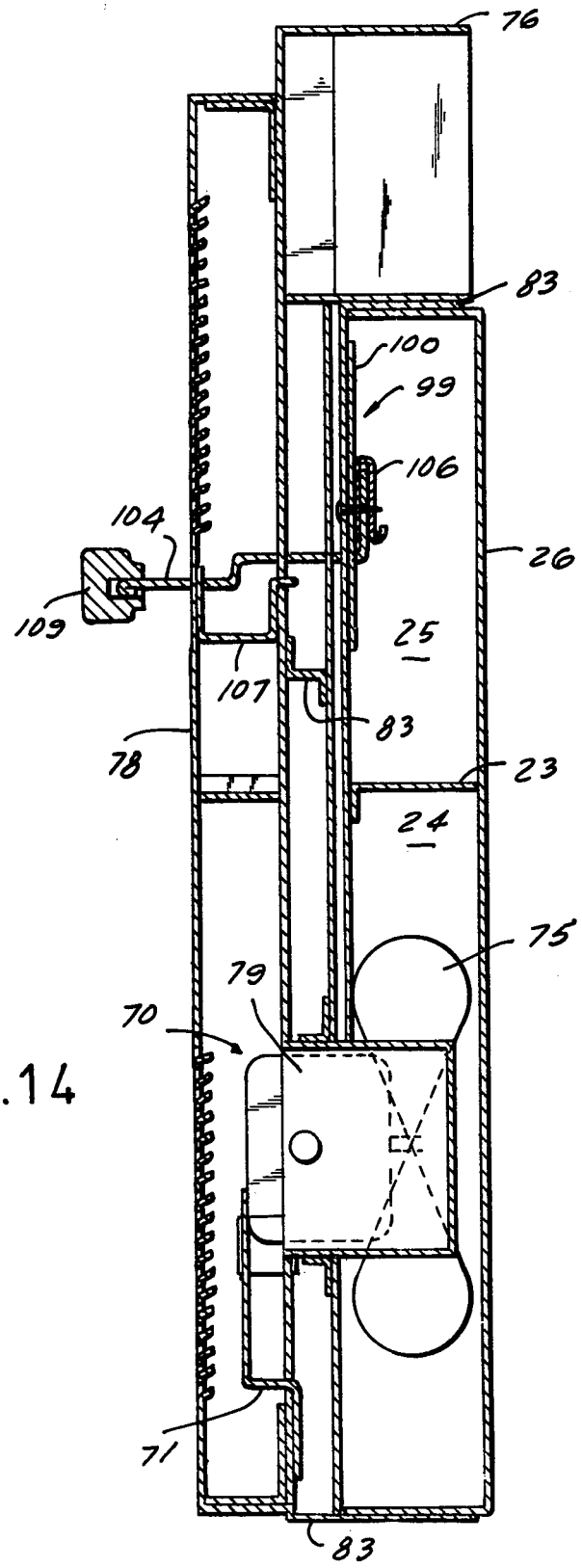
FIG. 14 is a vertical sectional view of the air conduit assembly as shown in FIG. 4.

Damper means 99, 99' positioned in outlet air duct 25, 25' and mounted adjacent to opening 62, 62' of heat exchanger duct extension 26, 26' is shown most clearly in FIGS. 4, 14 and 15.

FIG. 14 is a vertical sectional view of outlet air duct assembly which illustrates the coupling together of grille 78, side panel 76 and heat exchanger extension duct 26. Shown operatively mounted therein are damper assembly 99 and fan assembly 70. Damper means 99, 99' includes damper blades 100, 100' and is hingedly connected to hinge mounting plate 101, 101' through spring tabs 102, 102' which are disposed in slots 103, 103' of hinge mounting plate 101, 101'. An operating arm 104, 104', made of spring steel, is in the form of an offset lever. One end passes through opening 105, 105' in damper blade 100, 100' and is rigidly mounted thereto by selftapping screws threadedly connected to a Tinnerman clip 106, 106' mounted on the end thereof. A stop bracket 107, 107' is U-shaped and is mounted on the face of heat exchanger duct extension 26, 26' so that the open end of the U extends slightly above the base of outlet air opening 62, 62'. A latching slot 108, 108' is formed on each side of the U clip on bracket 107, 107' for retaining lever arm 104, 104' either in the mode which deflects air through remote duct 33*a*, 33'*a* as shown in dotted lines in FIG. 15 or when shifted to the other position deflects air through air opening 62, 62' shown in solid lines. Operating lever arm 104, 104' extends through opening 81, 81' and through the slot formed in the outlet air opening of louvered grille 78, 78'. A handle 109, 109' or other hand grasping device may be affixed to the end of the operating lever arm 104, 104'. In operation, damper means 99, 99' may be shifted to permit air to be discharged in the direction of the arrows through the outlet air opening of louvered grille 78, 78' by moving lever arm to the left and placing it under tension to latch in slot 108, 108 of stop bracket 107, 107'. Thus the heated air being discharged into the fireplace room is directed away from the opening of the fireplace and the radiant heat discharged therefrom so that uniform heating of the fireplace room is achieved. When air is to be deflected to the remote duct 33', 33'*a*, operating lever arm 104, 104' is unlatched in the left hand position and fixed to the right end position and latched into slot 107*a*, 107'*a*. When lever arm 104 is unlatched and is in the intermediate position, air is deflected through outlet opening 62, 62' and remote duct 33*a*, 33'*a*.

Figure 11:
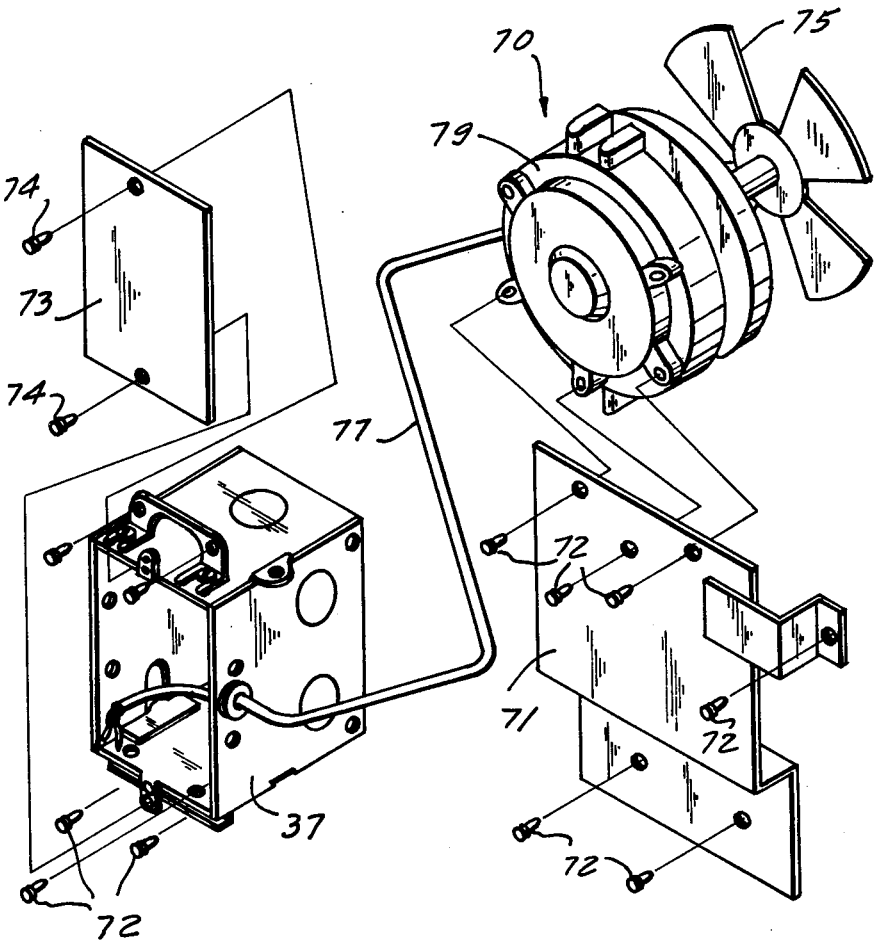
FIG. 11 is an exploded isometric view of a fan assembly of the third form of the invention as shown in FIG. 4.

Fan assembly 70, 70' as shown in FIG. 11 is mounted on the left side of heat exchanger module 20 shown in FIG. 4. A similar assembly is mounted on the right side. Fan assembly 70 is mounted on plate 71 in fixed position, for example, by selftapping metal screws 72. Plate 71 is mounted on the rear face of side extension panel 76 so that the fan motor 79 and shaft extend horizontally into the opening 60 of heat exchanger extension duct 26. Fan propeller blade 75 is mounted on the end of the shaft and rotates within inlet air duct 24. Electrical utility box 37 is mounted on the inside face of side extension panel 76 by conventional means, for example, selftapping metal screws or spot welding. Fan 70 is electrically connected by conduit 77 and is coupled to a power source, not shown, in utility box 37. The fan switch, which may be mounted on an adjacent wall of the room housing the fireplace, not shown, is electrically connected to utility box 37. The cover 73 is mounted over the opening of utilitity box 37 by threaded screws 74.

Figure 6:
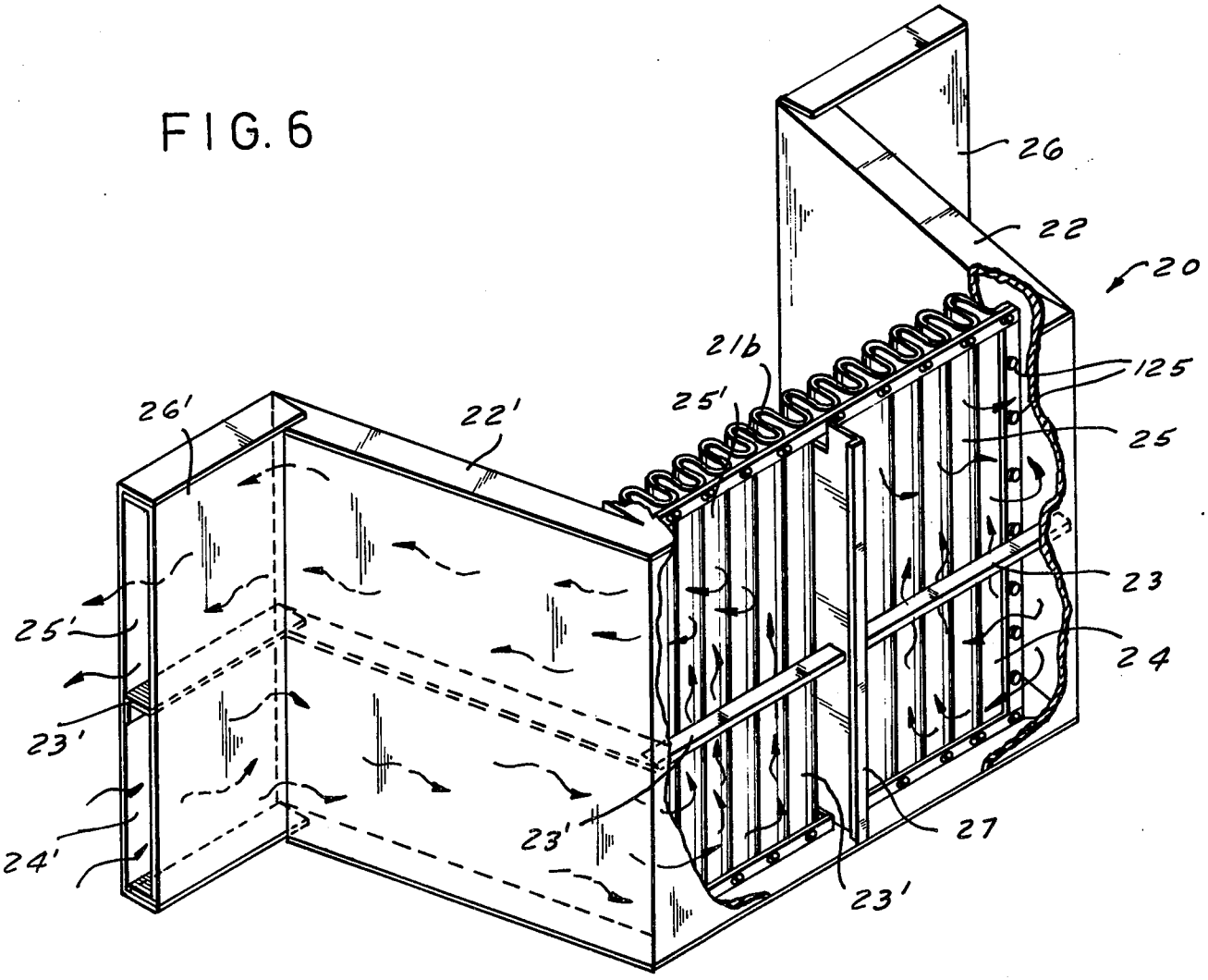
FIG. 6 is an isometric view partially broken away of another form of the heat exchanger mounted to the insert module and illustrates the air flow path of the forms of the invention shown in FIGS. 2, 3 and 4.

FIG. 6 is an isometric view of the heat exchanger and conduit system as viewed from the rear partially broken away to illustrate the air flow path typical of the forms of the invention herein. Heat exchanger surface 21 is shown as a convoluted surface 21*b* to be explained further in FIG. 9. Left and right air conduits 22, 22', of insert module 20 are separated by vertical baffle 27 which extends between the top and bottom surfaces of air conduit 22, 22'. Air flow divider or baffle 23, 23' is horizontally disposed in conduit 22, 22' and is mounted against the interior surfaces of the vertical walls forming conduit 22, 22'. The end of air flow divider of 23, 23' is mounted in abutting relation to vertical baffle 27. Conduit extensions 26, 26' are mounted to the outlet ends of conduit 22, 22' and includes extension of horizontal air divider 23, 23' to provide a lower inlet air duct 24, 24' and upper outlet air duct 25, 25'.

Figure 7:
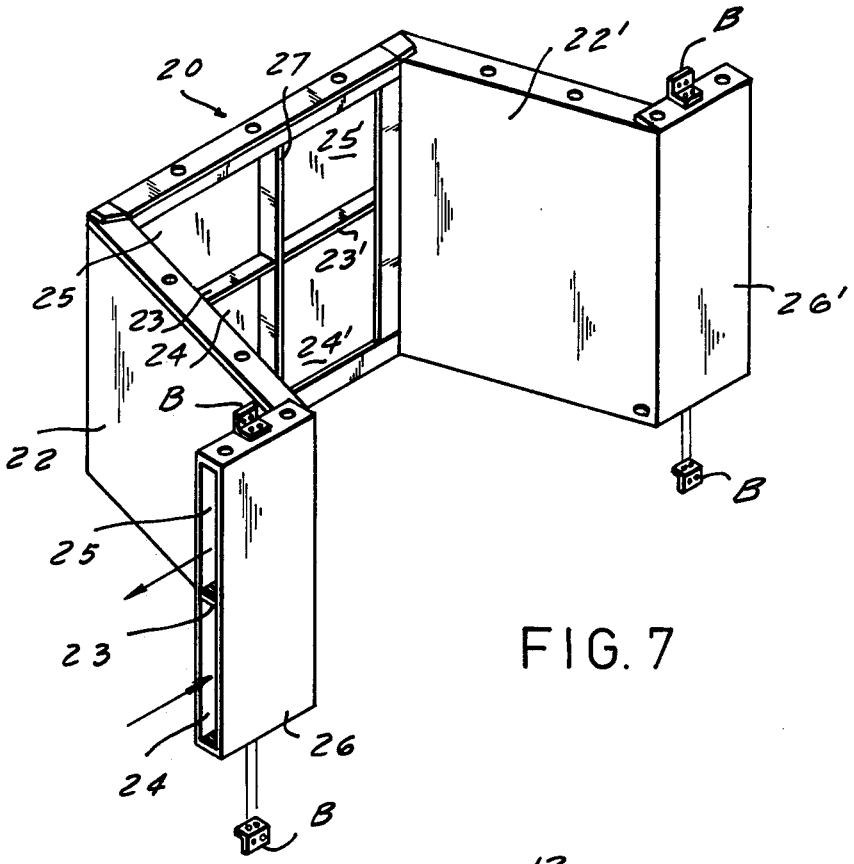
FIG. 7 is an isometric view of the insert module shown from the other side thereof of FIG. 6 with the heat exchanger removed.

FIG. 7 illustrates the conduit system shown from the other side of FIG. 6 with heat exchanger surface 21*b* removed. The front face of conduit 22, 22' which extends along the rear wall of combustion chamber 14 is removed so that heat exchanger surface 21 can be mounted thereto. As indicated by the direction of the arrows in FIG. 6 air is introduced into inlet air duct 24, 24' and is limited in its direction of flow by horizontal baffle 23, 23' and vertical baffle 27, 27'. Thus all of the air flowing through duct 24, 24' must flow in a vertical direction upwardly into duct 25, 25' in heat transfer contact with the heat exchanger surface 21 and this is directed outwardly through outlet air duct 25, 25'. Mounting brackets B for holding insert module 20 in fixed position within the combustion chamber of a fireplace are mounted to the top and bottom surfaces of heat exchanger extension panel 26, 26'.

FIG. 8 is a fragmentary sectional view of the fireplace assembly of FIG. 1 with the dome section removed. The casings 17, 18 and combustion chamber 14 of the fireplace 12 are shown with an air space A between insert module 20 and the combustion chamber 14. It should be noted that the firebrick wall normally employed as the back wall of the combustion chamber and the sideliners mounted adjacent each side wall of the combustion chamber in a prefabricated fireplace assembly are removed. Insert module 20 is positioned in spaced relation with the rear wall of the combustion chamber with primary heat exchanger surface 21 mounted in fluid communication with heat exchanger ducts 22, 22'. Coupled to the inlet air and outlet air openings of ducts 24, 24', 25, 25' are air conducting system 30, 30'.

Figure 9:
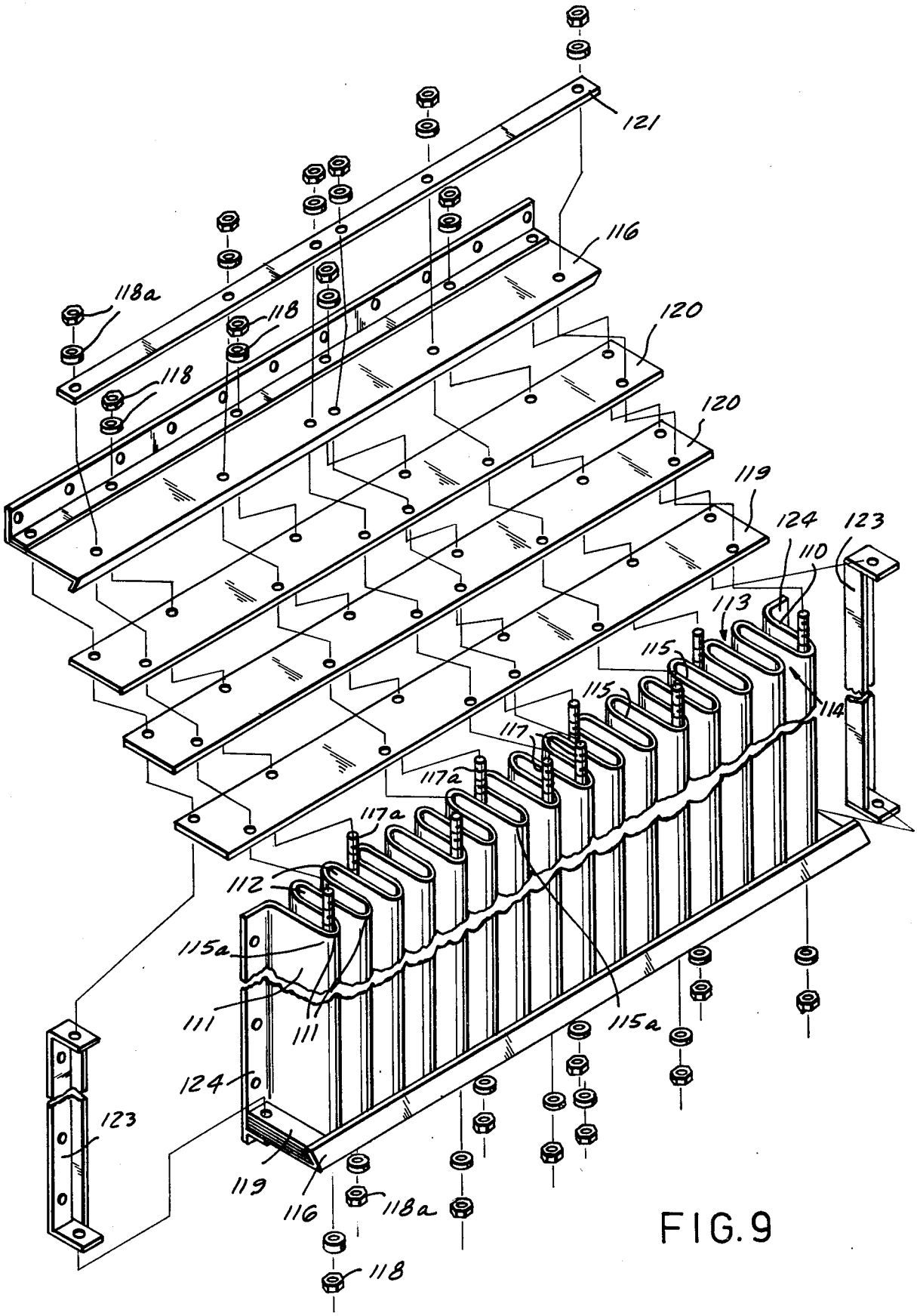
FIG. 9 is an exploded isometric view of the heat exchanger assembly shown in FIG. 6.
Figure 10:
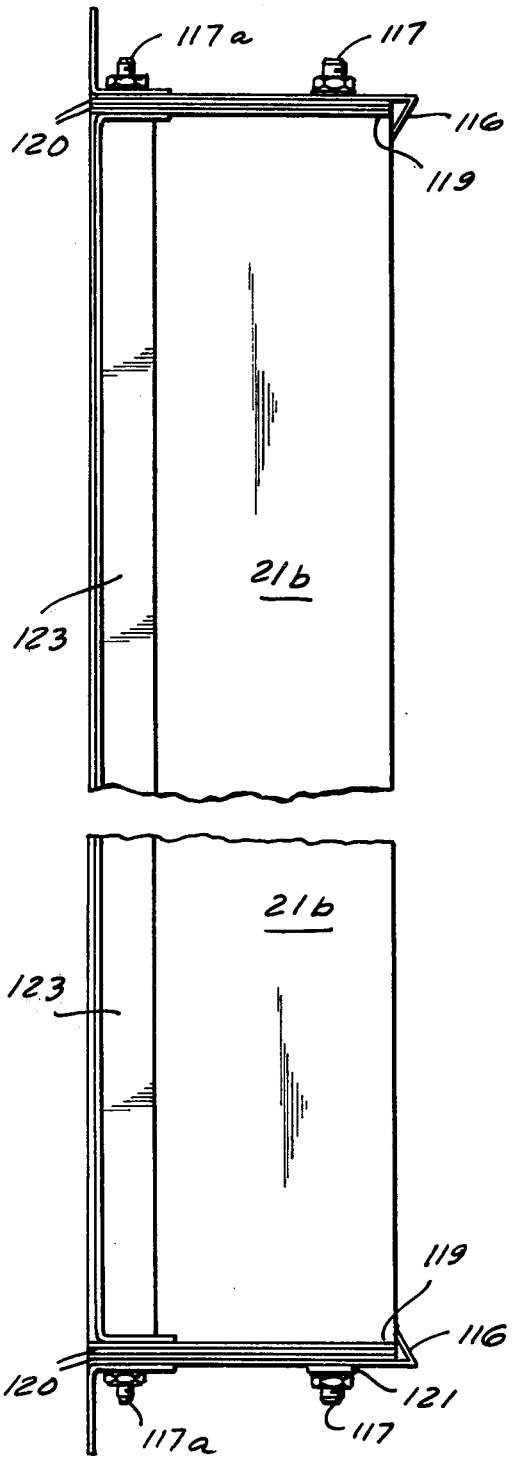
FIG. 10 is a side elevational view of the heat exchanger fully assembled as seen in FIG. 9.

FIGS. 9 and 10 illustrate the assembly of a preferred form of heat exchanger surface 21. Heat exchanger surface 21*b* is shaped in the form of a series of convolutions 110 which form alternating ridges 111, 112 and define complimentary gas passageways 113 and 114. Heat exchanger surface 21*b* is made of thin guage stainless steel, for example, type 430, 0.014 inch thick, each convolution having a radius of curvature of approximately 5/16 of an inch and a depth of approximately 2½ inches. As illustrated particularly in FIG. 6 heat exchanger surface 21b is disposed on heat exchanger conduit 22, 22' so that the convoluted surface is oriented vertically to maintain optimum flame impingement along its length. Air to be heated is directed vertically in air passageway 113 formed between adjacent convolutions on the one side of heat exchanger surface 21b and the combustion passageway 114 formed between adjacent convolutions on the other side. The space between each convolution and its depth is such as to permit optimum flame impingement at the base 115 of each convolution. It has been found that as the spacing between each convolution becomes too narrow, the surfaces between adjacent convolutions defining combustion gas passageway 114 will not be fully heated by direct flame impingement against the surfaces. The depth of each convolution should also permit sufficient flow of hot gases in passageway 114 forming each convolution. It has been found that the number of convolutions per inch may vary greatly from about 0.10 to about 4 convolutions per inch and preferably from about 0.5 to about 3 convolutions per inch and still more preferably from about 0.8 to about 1.6 convolutions per inch. A commercially acceptable design which increases the heat transfer surface area at least several times greater than the surface area of the rear wall of the combustion chamber is shown in FIG. 9. By forming compact convolutions, the surface area of the heat exchanger surface is greatly increased, for example where the surface area of the rear wall of the insert module 20 is approximately 3 square feet, the surface area of the heat exchanger surface 21b can be increased to 12 square feet or more depending upon the radius of the curvature of the formed convolutions. Such a surface permits sufficient flow of gases in the vertically oriented passageways 114 and the thin stainless steel surface permits increased heat energy to be transferred from the combustion gases on the one side to the air to be heated on the other side thereof. Heat exchanger surface 21b as illustrated comprises 0.8 convolutions per inch, having 5/16 inch radius of curvature, a depth of 2½ inches to form vertically oriented and complimentary gas passageways 113 and 114. The surface area formed thereby is approximately four times greater than the surface area of the rear wall of the combustion chamber and achieves an increase of heat transfer performance of approximately 39%.

The heat exchanger surface 21b is assembled by providing a pair of mounting plates 116 which are positioned along the top and bottom of heat exchanger surface 21b. A plurality of space tie rods 117 are nested in bases 115a of convolution 110 to provide a row of vertically extending tie rods 117. A second row of spaced tie rods 117a are positioned in air passageways 113 to provide a second row of vertically extending tie rods with each row being parallel to each other. Each tie rod is threaded at its ends for receiving lock nuts 118, 118a for threaded engagement therewith. A rectangular shim stock 119 having complimentary openings for passing the ends of vertical tie rods 117, 117a therethrough and is positioned on the top and bottom of the heat exchanger surface 21b. Similar shaped rectangular sections of insulation 120 having complimentary openings therein are placed on top of the shim stock 119. Mounting plate 116 is positioned over insulation gasket 120. A washer bar 121 is placed over threaded ends of tie rods 117 and rests on top surface of mounting plate 116. Lock washers and nuts 118 are threaded into place to hold one edge of the mounting plate biased against the top surface of the heat exchanger surface 21b. The back edge of mounting plate 116 is formed having an angle with openings formed in its vertical flange 112. The openings on its horizontal surface are complimentary to the rear tie rods 117a so that the tie rods can be inserted therethrough. Thereafter lock washers and nuts 118a are threaded in place on the ends of tie rods 117a. The bottom assembly of heat exchanger surface 21b is identical to the top assembly and is assembled as discussed above. A pair of side angle members 123 are mounted on the horizontal flange 124 of heat exchanger surface 21b with the top and bottom of each side angle having an extension formed normal with the horizontal flange 124 of heat exchanger surface 21b. An opening is formed therein to receive a bolt to hold the top and bottom mounting assembly to the side angle. Each side angle 123 has a plurality of spaced openings along its length so that a plurality of complimentary spaced bolts 125 shown in FIG. 6, are positioned around the flange surface of conduit 22, 22' to mount heat exchanger surface 21b thereon. Bolts 125 also pass through complimentary openings formed in the top and bottom mounting assembly as described above. Thereafter heat exchanger surface 21b is bolted into place. The tie rods 117, 117a together with the top and bottom mounting assemblies and side angles add rigidity to the heat exchanger surface 21b so that accidental bending and/or deformation thereof is minimized when logs or other solid fuel are negligently forced against it. Since heat exchanger surface 21b and heat exchanger duct 22, 22' are made of stainless steel each can withstand high temperatures without the metal burning out or otherwise deteriorating due to excessive heat.

In a test utilizing the invention herein, the insert module assembly was mounted in the hearth of a fireplace constructed substantially as described and shown in U.S. Pat. No. 2,821,975. The fireplace was modified in that the sideliners mounted on each side of the hearth were removed and the brick retainer lock for holding the brick rear wall was removed. This assembly was tested and compared with two modified heat exchanger surfaces. The convoluted heat exchanger surface in Test 1 was removed and replaced with a flat stainless steel plate 0.035 inch think, weighing 4.5 pounds and having a surface area of 3 square feet. A third form of heat exchanger surface was substituted for the convoluted surface and was made of hot rolled steel flat plate, 0.163 inch think, 20 vertically oriented fins, 15 inches long, 3 inches in height, 0.163 inch thick, spaced 1 inch on center and having surface area of 16 square feet weighing 110 pounds. The convoluted heat exchanger surface used in Test 1 was made of 0.014 gauge stainless steel having a total surface area of 12 square feet, weighing 7.5 pounds, 16 convolutions on 5/16 inch radius of curvature forming 0.8 convolutions per inch, having a height of 2½ inches, each being 19 inches long. Each of the three tests utilized kiln dried Douglas Fir fuel maintaining a fueling rate of 10 pounds per hour. The quantity of heat transferred from the combustion gases to the air passing through the insert module was calculated according to the formula: $Q=0.24\ (T)\ (W)$ where:

Q=heat gain (BTU/hr)
T=Temperature rise (°F.)
W=Mass rate of air flow (lbs/hr)
24 Specific heat of air (BTU/lb/°F.)

Each insert module was mounted in the fireplace assembly of FIG. 1. The test results are tabulated below:

| | Air Temp. Rise (T) | | | Air Flow Rate (W) | | | Per Side Heat Gain | Improvement |
|---|---|---|---|---|---|---|---|---|
| | Left | Right | Avg. | Left | Right | Avg. | (Q) | % |
| Convoluted surface | 61.0 | 51.0 | 56.0 | 7.0 | 7.2 | 7.1 | 5725 | 39 |
| Plain Flat surface | 41.5 | 31.5 | 36.5 | 7.9 | 7.8 | 7.85 | 4126 | reference |
| Fin surface | 49.0 | 51.0 | 50.0 | 7.9 | 7.8 | 7.85 | 5652 | 37 |

From the above data the design evaluation can be taken as follows:

M=weight in lbs. of heat exchanger surface

A=square feet

I=improvement factor (I A/M)=heat gain index

| | Weight (M) | Surface Area (A) | Improvement Factor (I) | Heat Gain Index $\frac{(I\ A)}{(M)}$ |
|---|---|---|---|---|
| Convoluted Surface | 7.5 | 12 | 1.39 | 2.22 |
| Plain Flat surface | 4.5 | 3 | 1 | .67 |
| Fin surface | 110.0 | 16 | 1.37 | .20 |

The advantages attributed to each particular design are (1) the available heat transfer area and (2) the total amount of heat capable of being transferred from the combustion gases to the air to be heated. Conversely, the disadvantage of a particular design is the amount of material needed to construct the heat exchanger surface. The advantages of a particular design divided by its disadvantages results in an index of design effectiveness, or the Heat Gain Index. From the above table it is readily seen that the convoluted heat exchanger surface is the most effective design.

From the foregoing description of the invention, a heat exchanger surface capable of increasing the quantity of heat transferred from the combustion gases to the air to be heated has been described. Since the heat exchanger surface is convoluted and oriented vertically the air to be heated and the combustion gases are in heat transfer contact with a heat transfer surface which is at least 4 times greater than the surface area of the rear wall of the hearth. This increase of effective heat exchanger surface area has been provided by the convolutions. The insert module assembly is relatively easy to manufacture, is made of lightweight components and of durable fire resistant metals which do not easily deform or otherwise deteriorate when exposed to high temperatures. When the insert module is incorporated in a fireplace assembly, air control means associated with a conduit assembly including room air and/or outside inlet air sources and outlet duct means capable of discharging heated air into a room or rooms thereby making the fireplace a supplemental source of heat energy which normally would be expelled to the outside atmosphere via the flue.

Thus the several above noted objects and advantages are most effectively attained. Although several somewhat preferred embodiments have been disclosed and described in detail herein, it should be understood that this invention is in no sense limited thereby and its scope is to be determined by that of the appended claims.

What is claimed:

1. An insert module assembly adapted to be mounted in the combustion chamber of a fireplace to recover and utilize substantial quantities of heat energy which normally would be expelled to the outside atmosphere, said insert module comprising:

an inlet air duct and outlet air duct for conducting air to be heated into and out of said inlet module and being positioned adjacent the rear wall of said combustion chamber;

a heat exchanger formed of sheet metal and defining the front vertical wall of said insert module; said heat exchanger being mounted in fluid communication with said inlet and outlet air duct for increasing the quantity of heat transferred from the combustion gases to the air from said inlet air duct which is to be heated;

said heat exchanger having a plurality of vertically oriented passageways for conducting combustion gases vertically upwards on the one side thereof and a plurality of complementary air passageways on the other side thereof for conducting inlet air to be heated vertically through said passageways;

said insert module having baffle means operatively coupled to said inlet air duct and said heat exchanger for directing all of said inlet air to be heated along said complementary air passageways and into said outlet air duct; and said heat exchanger defining said vertically oriented passageways having a surface area greater than the surface area of the rear wall of the combustion chamber.

2. The insert module assembly of claim 1 wherein said surface defining said passageways has an area at least several times greater than the surface area of the rear wall of the combustion chamber.

3. The insert module assembly of claim 1 wherein said heat exchanger surface is formed having a plurality of vertically oriented convolutions and having from about 0.10 to about 4 convolutions per inch.

4. The insert module assembly of claim 3 wherein the number of convolutions per inch is from about 0.5 to about 3.

5. The insert module assembly of claim 3 wherein the number of convolutions per inch is from about 0.8 to about 1.6.

6. The insert module assembly of claim 1 wherein said heat exchanger surface is formed having a plurality of vertically oriented convolutions, each convolution having a 5/16 inch radius of curvature and forming 0.8 convolutions per inch.

7. The insert module assembly of claim 1 wherein said inlet and outlet air ducts of said air conducting assembly includes inlet and outlet air duct extensions so that the inlet and outlet air openings are mounted remotely from said insert module.

8. The insert module assembly of claim 1 wherein the vertically oriented passageways of the heat exchanger surface are formed having a depth of about 2½ inches.

9. The insert module assembly of claim 1 wherein the surface area of said heat exchanger surface is at least four times as great as the surface area of the rear wall of the combustion chamber.

10. The insert module assembly of claim 1 wherein said inlet air duct and outlet air duct are disposed in vertical alignment so that inlet air to be heated is conducted vertically upwards along said plurality of complementary vertically oriented passageways.

11. The insert module assembly of claim 1 wherein said inlet air duct and said outlet air duct is generally rectangular and is adapted to be positioned adjacent the side walls and rear wall of the combustion chamber, said rectangular duct having a horizontal baffle positioned between the top and bottom walls thereof and is mounted to the front and rear vertical walls of said rectangular duct to provide vertically aligned inlet and outlet air ducts, a vertical baffle positioned between the ends of said rectangular duct and mounted in abutting relation to said horizontal baffle, top, bottom, and rear vertical walls thereof to provide a pair of right and left inlet and outlet air ducts, a heat exchanger is disposed adjacent said rear wall of said combustion chamber; said heat exchanger is mounted on said duct to define the front vertical wall of a segment of said rectangular duct, to cover portions of said pairs of said right and left inlet and outlet air ducts including said vertical baffle and segment of said horizontal baffle, said heat exchanger operatively coupled to said segment of said horizontal baffle to provide a plurality of air passageways therebetween so that inlet air to be heated is directed vertically along said complementary vertically oriented passageways, through said plurality of openings and into said outlet air duct.

12. The insert module assembly of claim 11 wherein said outlet air duct is disposed above said horizontal baffle so that air to be heated is conducted vertically upwards through said complementary air passageways of said heat exchanger.

13. The insert module assembly of claim 11 wherein said outlet air duct is positioned below said horizontal baffle so that air to be heated is conducted vertically downward through said complementary air passageways of said heat exchanger.

14. The insert assembly of claim 1 wherein said heat exchanger surface is made of 0.014 gauge stainless steel having a surface area of 12 square feet, a weight of 7.5 pounds, an improvement factor of 1.39 and a heat gain index of 2.22.

15. The insert module assembly of claim 1 wherein said heat exchanger is made of a plurality of serially connected, vertically oriented, triangular shaped members to provide alternating triangular gas passageways on the one side of said surface and complementary alternating triangular air passageways on the other side.

16. An air circulating fireplace arranged and constructed to recover and utilize substantial quantities of heat energy which normally would be expelled to the outside atmosphere, through the chimney flue, said fireplace comprising:

a combustion chamber having a hearth floor, a rear wall, left and right side walls and a dome having a flue opening for exhausting products of combustion from fuel being burned in said chamber;

an insert module assembly mounted in said combustion chamber and including an inlet air duct and outlet air duct for conducting air to be heated into and out of said insert module;

a heat exchanger formed of sheet metal and defining the front vertical wall of said insert module, said heat exchanger mounted in fluid communication with said inlet air and outlet air ducts increasing the quantity of heat transferred from said combustion gases to the air from said inlet air duct to be heated;

said heat exchanger having a plurality of vertically oriented passageways for conducting combustion gases vertically upwards on the one side thereof and a plurality of complementary vertical air passageways on the other side thereof for conducting inlet air to be heated vertically through said passageways;

said insert module having baffle means operatively coupled to said inlet air duct and said heat exchanger for directing all air to be heated along said complementary air passageways and into said outlet air duct; and said heat exchanger defining said vertically oriented passageways having a surface area greater than the surface area of the rear wall of the combustion chamber.

17. The air circulating fireplace of claim 16 wherein said surfaces defining said vertically oriented passageways have an area at least several times greater than the surface area of the rear wall of the combustion chamber.

18. The air circulating fireplace of claim 16 wherein said heat exchanger surface is formed having a plurality of vertically oriented convolutions and having from about 0.10 to about 4 convolutions per inch.

19. The air circulating fireplace of claim 18 wherein the number of convolutions per inch is from about 0.5 to about 3.

20. The air circulating fireplace of claim 18 wherein the number of convolutions per inch is from about 0.8 to about 1.6.

21. The air circulating fireplace of claim 16 wherein said heat exchanger surface is formed having a plurality of vertically oriented convolutions, each convolution having a 5/16 inch radius of curvature and forming 0.8 convolutions per inch.

22. The air circulating fireplace of claim 16 wherein said inlet and outlet air ducts of said air conducting assembly includes inlet and outlet air duct extensions so that the inlet and outlet air openings are mounted remotely from said insert module.

23. The air circulating fireplace of claim 16 wherein said inlet air duct and said air duct is generally rectangular and is positioned adjacent the side walls and rear wall of the combustion chamber, said rectangular duct having a horizontal baffle positioned between the top and bottom walls thereof and is mounted to the front and rear vertical walls of said rectangular duct to provide vertically aligned inlet and outlet air ducts, a vertical baffle positioned between the ends of said rectangular duct and mounted in abutting relation to said horizontal baffle, top, bottom and rear vertical walls thereof to provide a pair of right and left inlet and outlet air ducts, a heat exchanger is disposed adjacent said rear wall of said combustion chamber, said heat exchanger is mounted on said duct to define the front vertical wall of a segment of said rectangular duct to cover portions of said pairs of said right and left inlet air ducts including said vertical baffle and segment of said horizontal baffle, said heat exchanger is operatively coupled to said segment of said horizontal baffle to provide a plurality of air passageways therebetween so that inlet air to be heated is directed vertically along said complementary vertically oriented passageways, through said plurality of openings and into said outlet air duct.

24. The air circulating fireplace of claim 23 wherein said pairs of inlet and outlet air ducts are disposed adjacent to the side walls of the combustion chamber so that air being discharged through the pair of outlet air ducts is directed away from the combustion chamber.

25. The air circulating fireplace of claim 23 wherein said outlet air duct is disposed above said horizontal baffle so that air to be heated is conducted vertically upwards through said complementary air passageways of said heat exchanger.

26. The air circulating fireplace of claim 23 wherein said outlet air duct is positioned below said horizontal baffle so that air to be heated is conducted vertically downward through said complementary air passageways of said heat exchanger.

27. The air circulating fireplace of claim 23 wherein said rectangular conduit extends laterally away from each side wall of the combustion chamber and said top duct of said vertically aligned air duct is an outlet air duct having a discharge air opening therein, damper means is operably mounted in said outlet air duct to cover and uncover said opening; a remote duct having a discharge opening disposed between the fireplace and an adjacent room to be heated is mounted to said outlet air duct so that said damper means is operable to proportion heated air being discharged between the outlet openings of said outlet air duct and the discharge air opening of said remote duct.

28. The air circulating fireplace assembly of claim 23 wherein said rectangular duct extends laterally away from each side wall of the combustion chamber and said bottom duct of said vertically aligned air duct is an inlet air duct having an inlet air opening therein, fan means is operably mounted in fluid communication with said inlet air duct to circulate air to be heated from the fireplace room through the inlet opening of said inlet air duct.

29. The air circulating fireplace of claim 16 wherein said heat exchanger is formed having a plurality of vertically oriented convolutions, each convolution having a 5/16 inch radius of curvature and forming 0.8 convolutions per inch.

30. The air circulating fireplace of claim 29 wherein the air passageways are formed in alternating relation so that hot combustion gases are conducted vertically along alternating passageways on the one side thereof while air to be heated is conducted vertically along complementary passageways on the other side thereof.

31. The air circulating fireplace of claim 16 wherein the vertically oriented passageways are formed having a depth of about 2½ inches.

32. The air circulating fireplace of claim 16 wherein the surface area of said heat exchanger is at least four times as great as the surface area of the rear wall of the combustion chamber.

33. The air circulating fireplace of claim 16 wherein said heat exchanger is made of 0.014 gauge stainless steel having a surface area of 12 square feet, a weight of 7.5 pounds, an improvement factor of 1.39 and a heat gain index of 2.22.

34. The air circulating fireplace of claim 16 wherein said heat exchanger is made of a plurality of serially connected, vertically oriented, triangular shaped members to provide alternating triangular gas passageways on the one side of said surface and complementary alternating triangular air passageways on the other side.

* * * * *